US009463579B2

(12) United States Patent
Oguchi

(10) Patent No.: US 9,463,579 B2
(45) **Date of Patent: *Oct. 11, 2016**

(54) SHEET MANUFACTURING APPARATUS AND SHEET MANUFACTURING METHOD

(71) Applicant: SEIKO EPSON CORPORATION, Tokyo (JP)

(72) Inventor: Yuki Oguchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/625,029

(22) Filed: Feb. 18, 2015

(65) Prior Publication Data

US 2015/0240422 A1 Aug. 27, 2015

(30) Foreign Application Priority Data

Feb. 21, 2014 (JP) ..... 2014-031421

(51) Int. Cl.

| | |
|---|---|
| ***D21D 5/24*** | (2006.01) |
| ***D21F 9/00*** | (2006.01) |
| ***D04H 1/732*** | (2012.01) |
| ***B27N 3/04*** | (2006.01) |
| ***B27N 3/12*** | (2006.01) |

(52) U.S. Cl.

CPC . *B27N 3/04* (2013.01); *B27N 3/12* (2013.01); *D04H 1/732* (2013.01); *D21D 5/24* (2013.01); *D21F 9/00* (2013.01)

(58) Field of Classification Search

CPC ..... D21D 5/24; D21D 5/00; B27N 3/04; B27N 3/12; D21H 11/14; D21H 25/005; D04H 1/732; D04H 1/74; D04H 1/1732; A61F 2013/530007; B07B 9/00; B07B 1/00; D21C 5/025; D21B 1/08; D21B 1/028; D21B 1/063; D21B 1/32; B28C 47/00; B28C 47/0009

See application file for complete search history.

(56) References Cited

U.S. PATENT DOCUMENTS

| | | | | |
|---|---|---|---|---|
| 2,646,381 | A * | 7/1953 | Duvall | B27N 1/00 19/58 |
| 2,972,171 | A * | 2/1961 | Heritage | D21D 5/00 162/55 |
| 3,418,095 | A * | 12/1968 | Kleist | C03B 37/06 264/12 |
| 3,611,508 | A * | 10/1971 | Reinhall et al. | D04H 1/425 19/303 |

(Continued)

FOREIGN PATENT DOCUMENTS

| | | | | |
|---|---|---|---|---|
| DE | WO 0071810 | A1 * | 11/2000 | B07B 4/02 |
| EP | 0159618 | B1 * | 1/1988 | D04H 1/425 |

(Continued)

*Primary Examiner* — Anthony Calandra
(74) *Attorney, Agent, or Firm* — Global IP Counselors, LLP

(57) ABSTRACT

A sheet manufacturing apparatus includes a defibrating unit configured to defibrate material containing fibers in the air, a classifying unit configured to classify by airflow defibrated material, which has been defibrated at the defibrating unit, into fiber material and waste material, a deposition unit configured to deposit the fiber material to create deposited material, a discharge blower configured to discharge the waste material by airflow from the classifying unit such that the waste material does not move toward a side of the deposition unit, a transfer blower configured to transfer by airflow the fiber material from the classifying unit to the deposition unit, and a forming unit configured to form a sheet by using the deposited material. When manufacturing by the sheet manufacturing apparatus starts, the discharge blower is driven before the transfer blower.

9 Claims, 3 Drawing Sheets

(56) References Cited

U.S. PATENT DOCUMENTS 3,717,905 A * 2/1973 Furbeck ..... A61F 13/15626 19/148
3,741,863 A * 6/1973 Hunter et al. ..... B27N 1/00 162/191
4,440,635 A * 4/1984 Reiniger ..... B02C 18/08 209/306
4,650,409 A * 3/1987 Nistri ..... D04H 1/425 156/62.4
5,013,405 A * 5/1991 Izard ..... C04B 26/02 162/101
5,324,389 A * 6/1994 Spencer ..... D21B 1/028 162/4
5,437,418 A * 8/1995 Graef ..... A61F 13/15707 241/152.2
8,882,965 B2 * 11/2014 Yamagami ..... D21B 1/08 162/261
8,986,505 B2 * 3/2015 Oguchi ..... B07B 1/00 162/259
9,045,857 B2 * 6/2015 Gomi ..... D21B 1/063
2005/0064169 A1 * 3/2005 Schiegl ..... B27N 1/0254 428/297.4
2012/0297560 A1 * 11/2012 Zwick ..... C11D 3/046 15/104.93
2014/0027075 A1 * 1/2014 Yamagami ..... D21B 1/08 162/4
2014/0290887 A1 * 10/2014 Gomi ..... D21B 1/063 162/252
2014/0290889 A1 * 10/2014 Oguchi ..... B07B 1/00 162/259
2014/0374047 A1 * 12/2014 Yamagami ..... D21B 1/08 162/261
2015/0096702 A1 * 4/2015 Higuchi ..... D21D 5/24 162/261
2015/0184341 A1 * 7/2015 Tanaka ..... D21F 7/00 162/252
2015/0240418 A1 * 8/2015 Oguchi ..... D21D 5/24 162/109
2015/0240422 A1 * 8/2015 Oguchi ..... D21F 9/00 162/202
2015/0247286 A1 * 9/2015 Nagai ..... D21F 7/003 162/261
2015/0252530 A1 * 9/2015 Higuchi ..... D21F 2/00 162/363
2015/0275429 A1 * 10/2015 Higuchi ..... D21F 9/04 162/261
2015/0275430 A1 * 10/2015 Higuchi ..... D21F 9/04 162/261
2015/0275435 A1 * 10/2015 Seki ..... D21H 17/20 162/5
2015/0292153 A1 * 10/2015 Miyazawa ..... D21D 5/24 162/261
2016/0068681 A1 * 3/2016 Ueno ..... D04H 1/587 428/36.4

FOREIGN PATENT DOCUMENTS

JP WO 9720090 A1 * 6/1997 ..... B41J 2/17513
JP 2001140184 A * 5/2001
JP WO 2010053035 A1 * 5/2010 ..... F26B 11/16
JP WO 2012095928 A1 * 7/2012 ..... D21B 1/08
JP 2012-144819 A 8/2012
JP 5214407 B2 * 6/2013 ..... F26B 11/16
WO WO 2012028535 A1 * 3/2012 ..... D21H 5/26

* cited by examiner

SHEET MANUFACTURING APPARATUS AND SHEET MANUFACTURING METHOD

CROSS-REFERENCE TO RELATED APPLICATIONS

This application claims priority to Japanese Patent Application No. 2014-031421 filed on Feb. 21, 2014. The entire disclosure of Japanese Patent Application No. 2014-031421 is hereby incorporated herein by reference.

BACKGROUND

1. Technical Field

The present invention relates to a sheet manufacturing apparatus and a sheet manufacturing method.

2. Related Art

Conventionally, a so-called wet method is adopted in a sheet manufacturing apparatus to inject raw materials containing fibers into water, defibrate primarily by mechanical action, and repulp. This kind of wet sheet manufacturing apparatus requires a large quantity of water, and the apparatus becomes large. Furthermore, in addition to the long time for equipment maintenance of the water treatment facilities, the energy related to the drying process becomes substantial.

Therefore, to reduce the size and conserve energy, a dry sheet manufacturing apparatus that uses as little water as possible is proposed (e.g., Japanese Laid-Open Patent Publication No. 2012-144819).

Japanese Laid-Open Patent Publication No. 2012-144819 describes defibrating pieces of paper in a dry defibrating machine into a fibrous form, classifying the fibers in a cyclone into ink particles and deinked fibers, and passing the deinked fibers through a screen with small holes on the front surface of a forming drum, depositing the fibers on a mesh belt, and forming into paper.

In the sheet manufacturing apparatus, the materials are transferred to each process by airflow, and various motors are provided to generate airflow in each process. In addition, the waste materials and fine particles such as resin particles and ink particles included in the raw materials are removed in the sheet manufacturing apparatus. In the sheet manufacturing apparatus described in Japanese Laid-Open Patent Publication No. 2012-144819, the starting order and the stopping order of the various motors when the apparatus starts and when the apparatus stops are not specified. Therefore, in practice, when the apparatus starts or when the apparatus stops, the removed objects flow backwards and become mixed into the sheet.

SUMMARY

The present invention solves at least a portion of the problems described above and can be implemented as the following embodiments or applied examples.

One aspect of a sheet manufacturing apparatus related to the invention is provided with a defibrating unit configured to defibrate material containing fibers in the air, a classifying unit configured to classify by airflow defibrated material that has been defibrated at the defibrating unit into fiber material and waste material, a deposition unit configured to deposit the fiber material to create deposited material, a discharge blower configured to discharge the waste material by airflow from the classifying unit such that the waste material does not move toward a side of the deposition unit, a transfer blower configured to transfer the fiber material by airflow from the classifying unit to the deposition unit, a suction unit configured to suction the deposited material from below, and a forming unit configured to form a sheet by using the deposited material. When manufacturing by the sheet manufacturing apparatus starts, the discharge blower is driven before the transfer blower.

In this kind of sheet manufacturing apparatus, the transfer blower that transfers the fiber material downstream by airflow from the classifying unit and the discharge blower that discharges the waste material by airflow from the classifying unit generate airflows in respectively opposite directions. When sheet manufacturing starts, by driving the discharge blower before the transfer blower, the back flow of the waste material collected by the discharge blower can be suppressed.

In a sheet manufacturing apparatus related to another aspect of the invention, when the manufacturing by the sheet manufacturing apparatus starts, the suction unit may be driven before the transfer blower.

In this kind of sheet manufacturing apparatus, when sheet manufacturing starts, by driving the suction unit before the transfer blower, back flow of the fine particles collected by the suction unit can be suppressed.

In the sheet manufacturing apparatus related to another aspect of the invention, when the manufacturing by the sheet manufacturing apparatus starts, one of the discharge blower and the suction unit is driven before an effect of airflow caused by driving of the other reaches the one.

In this kind of sheet manufacturing apparatus, the discharge blower and the suction unit generate airflows in mutually opposite directions. At the start of sheet manufacturing, the one is driven before the effect of the airflow caused by driving of the other reaches the one. Thus, back flow of the waste material collected by the discharge blower can be suppressed, and back flow of fine particles collected by the suction unit can be suppressed.

In the sheet manufacturing apparatus related to another aspect of the invention, when the manufacturing by the sheet manufacturing apparatus starts, the discharge blower may be driven before the defibrating unit.

In this kind of sheet manufacturing apparatus, when sheet manufacturing starts, by driving the discharge blower before the defibrating unit, back flow of the waste material collected by the discharge blower can be suppressed.

Another aspect of a sheet manufacturing method related to the invention includes defibrating material containing fibers in the air, classifying by airflow the defibrated material, which has been defibrated, into fiber material and waste material by a classifying unit, transferring the fiber material by airflow by a transfer blower, depositing the fiber material being transferred to create deposited material by a deposition unit, discharging by a discharge blower the waste material by airflow from the classifying unit such that the waste material does not move toward a side of the deposition unit, suctioning the deposited material from below, and forming a sheet by using the deposited material. When sheet manufacturing starts, the discharge blower is driven before the transfer blower.

In this kind of sheet manufacturing method, the transfer blower generates airflow in the direction opposite to the airflow generated by the discharge blower. When sheet manufacturing starts, by driving the discharge blower before the transfer blower, back flow of the waste material collected by the discharge blower can be suppressed.

BRIEF DESCRIPTION OF THE DRAWINGS

Referring now to the attached drawings which form a part of this original disclosure.

DETAILED DESCRIPTION OF EXEMPLARY EMBODIMENTS

Preferred embodiments of the present invention are explained in detail below with reference to the drawings. The embodiments explained below do not unfairly limit the content of the present invention described in the Scope of the Patent Claims. In addition, the entire configuration described below does not limit the essential configuration conditions of the present invention.

1. Configuration

Figure 1:
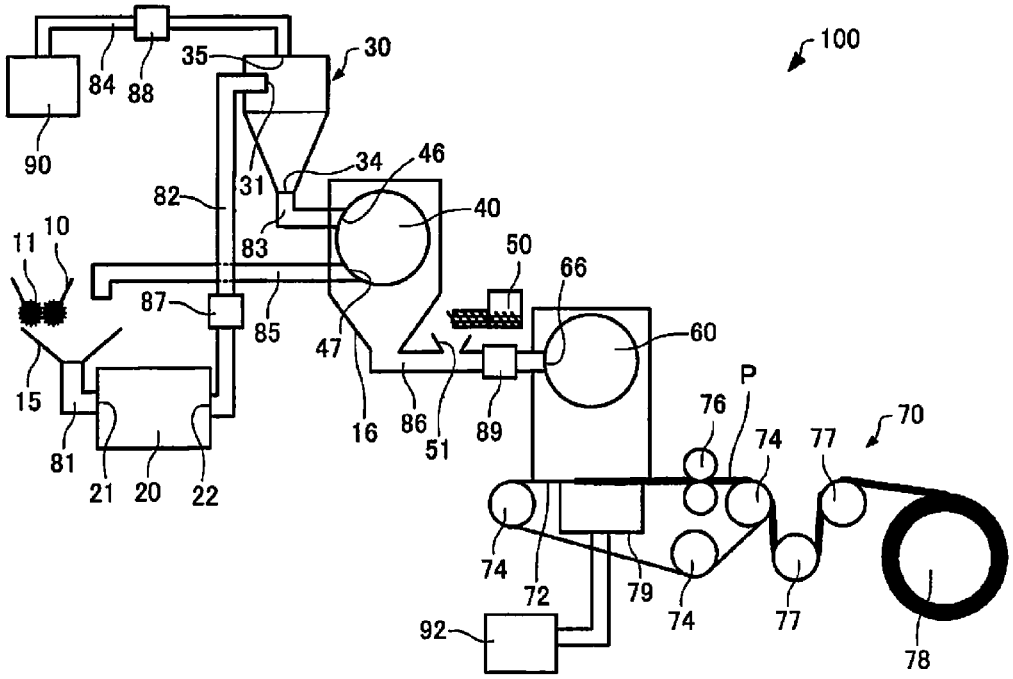
FIG. 1 is a diagram that schematically shows a sheet manufacturing apparatus related to this embodiment.

FIG. 1 is a diagram that schematically shows a sheet manufacturing apparatus 100 related to this embodiment. As shown in FIG. 1, the sheet manufacturing apparatus 100 includes a crushing unit 10, a defibrating unit 20, a classifying unit 30, a screening unit 40, a resin supply unit 50, a refining unit 60, and a forming unit 70.

The crushing unit 10 (supply unit) cuts the raw materials such as pulp sheets or fed-in sheets (e.g., used A4-size paper) into small pieces in the air. The sizes and shapes of the pieces are not particularly limited, but, for example, the pieces are several centimeters (cm) square. In the example shown, the crushing unit 10 has a crushing blade 11 and can cut the fed-in raw materials by using this crushing blade 11. An automatic feeding unit (not shown) may be provided in the crushing unit 10 to continuously feed in raw materials. The crushing unit 10 functions as the supply unit for supplying raw materials (materials containing fibers), but a sheet supply unit may be provided to supply raw materials in the form of sheets as the supply unit.

After being received in a hopper 15, the pieces cut by the crushing unit 10 are transferred by a first transfer unit 81 to the defibrating unit 20. The first transfer unit 81 is connected to an introduction port 21 of the defibrating unit 20. For example, the shapes of the first transfer unit 81 and the second to the sixth transfer units 82 to 86, which are described later, are tubular.

The defibrating unit 20 defibrates the pieces (defibration object). The defibrating unit 20 defibrates the pieces to generate untangled fibers in a fibrous form.

Here, "defibrates" means to untangle the pieces of a plurality of bonded fibers into individual fibers. The object passed out by the defibrating unit 20 is referred to as "defibrated material." In addition to the untangled fibers, the "defibrated material" may include resin particles (resin for bonding a plurality of fibers together) and ink particles such as ink, toner, and blur-preventing materials that separated from the fibers when the fibers were untangled. In the later description, the "defibrated material" is at least a part of the materials that passed through the defibrating unit 20 and may be mixed with materials added after passing through the defibrating unit 20.

The defibrating unit 20 separates the resin particles and the ink particles such as ink, toner, and blur-preventing materials that are adhering to the pieces from the fibers. The resin particles and the ink particles are discharged with the defibrated material from a discharge port 22. The defibrating unit 20 defibrates the pieces introduced from the introduction port 21 by a rotating blade. The defibrating unit 20 defibrates in the air in a dry system.

Preferably, the defibrating unit 20 has a mechanism for generating airflow. In this case, the defibrating unit 20 can suction the pieces with the airflow from the introduction port 21 using the self-generated airflow, defibrate, and transfer to the discharge port 22. The defibrated material discharged from the discharge port 22 is introduced to the classifying unit 30 by the second transfer unit 82. If the defibrating unit 20 being used does not have an airflow generation mechanism, a mechanism that generates airflow to introduce the pieces into the introduction port 21 may be attached externally.

The defibrated material discharged from the discharge port 22 is introduced to the classifying unit 30 via the second transfer unit 82. A post-defibration blower 87 that generates airflow to introduce the defibrated material to the classifying unit 30 is provided in the second transfer unit 82. When the defibrating unit 20 has an airflow generation mechanism, the post-defibration blower 87 may be omitted in the configuration of the sheet manufacturing apparatus 100.

The classifying unit 30 separates and removes resin particles and ink particles from the defibrated material. An airflow classifier is used as the classifying unit 30. An airflow classifier generates a rotating airflow to separate by size and density the materials classified by centrifugal force, and can adjust the classification points by adjusting the speed of the airflow and the centrifugal force. Specifically, a cyclone, an elbow jet, and an eddy classifier, and the like are used as the classifying unit 30. In particular, the cyclone can be preferably used as the classifying unit 30 to simplify the configuration. Cases in which a cyclone is used as the classifying unit 30 are explained below.

The classifying unit 30 has at least an introduction port 31, a lower discharge port 34 provided in the lower part, and an upper discharge port 35 provided in the upper part. In the classifying unit 30, the airflow carrying defibrated material that was introduced from the introduction port 31 has rotary motion. Due to this, centrifugal forces are applied to the introduced defibrated material to separate the material into fiber materials (untangled fibers) and waste materials that are smaller and less dense than the fiber materials (resin particles, ink particles). The fiber materials are discharged from the lower discharge port 34 and introduced into an introduction port 46 of the screening unit 40 by the third transfer unit 83. On the other hand, the waste materials are discharged to outside of the classifying unit 30 from the upper discharge port 35 and are introduced to a waste material collection container 90 through the fourth transfer unit 84. A discharge blower 88 is provided in the fourth transfer unit 84 to generate airflow to discharge the waste materials from the classifying unit 30 and introduce the waste materials to the waste material collection container 90.

The separation into fiber materials and waste materials by the classifying unit 30 was described, but exact separation is not possible. Among the fiber materials, relatively small fiber materials and low-density fiber materials are sometimes discharged to the outside with the waste materials. In addition, among the waste materials, relatively high-density waste materials or waste materials entangled with fiber materials are sometimes introduced with the fiber materials to the screening unit 40. In this application, the materials discharged from the lower discharge port 34 (materials having a higher percentage of including long fibers than waste materials) are referred to as "fiber materials," and the materials discharged from the upper discharge port 35 (materials having a lower percentage of including long fibers than fiber materials) are referred to as "waste materials."

The screening unit 40 screens the fiber materials separated by the classifying unit 30 in the air into "passed material" that passes through the screening unit 40 and "residue" that does not pass through. A sieve is used as the screening unit 40. The screening unit 40 has an introduction port 46 and a discharge port 47. The screening unit 40 is a rotating sieve that rotates a cylindrical mesh unit by using a motor (not shown). The mesh unit of the screening unit 40 has a plurality of openings, and the interior of the mesh part is a cavity. Among the fiber materials introduced inside of the mesh part, materials having sizes that are able to pass through the openings are passed, and materials having sizes that are unable to pass through the openings are not passed when the mesh unit is rotated. The screening unit 40 can use the sieve to screen the fibers shorter than a constant length (passed material) from the fiber materials. The mesh unit is configured from a metal mesh such as a woven metal mesh or a welded metal mesh. In the screening unit 40, the mesh unit configured from a metal mesh may be replaced by an expanded metal that is an extended metal plate with slits, or may be a punched metal of a metal plate formed with holes by a metal pressing machine. When the expanded metal is used, the openings are holes that are formed by lengthening the slits made in the metal plate. When the punching metal is used, the openings are the holes formed in a metal plate by a pressing machine. In addition, parts having openings may be produced from materials other than metal. The screening unit 40 may be omitted in the configuration of the sheet manufacturing apparatus 100.

Residue that was not passed by the sieve of the screening unit 40 is discharged from the discharge port 47, transferred to the hopper 15 through a fifth transfer unit 85 as the return flow path, and returned again to the defibrating unit 20. On the other hand, the passed material that passed through the sieve of the screening unit 40 is received in the hopper 16, then transferred through the sixth transfer unit 86 to an introduction port 66 of the refining unit 60. A supply port 51 is provided in the sixth transfer unit 86 to supply resin for bonding fibers together (defibrated materials together).

A resin supply unit 50 supplies resin in the air from the supply port 51 to the sixth transfer unit 86. In other words, the resin supply unit 50 supplies resin in the path (between the screening unit 40 and the refining unit 60) of the passed material that passed through the opening of the screening unit 40 from the screening unit 40 to the refining unit 60. The resin supply unit 50 is not particularly limited if resin can be supplied to the sixth transfer unit 86, but a screw feeder, a circle feeder, and the like are used. Resin supplied from the resin supply unit 50 is resin for bonding a plurality of fibers. When resin is supplied to the sixth transfer unit 86, the plurality of fibers is not bonded. The resin hardens when passed through the forming unit 70 to be described later to bond the plurality of fibers. The resin may be thermoplastic resin or thermosetting resin, and may be in a fibrous or a powder form. The amount of resin supplied from the resin supply unit 50 is appropriately set to correspond to the type of sheet to be manufactured. In addition to resin for bonding the fibers, coloring agents for coloring the fibers and coagulation inhibitors for preventing the coagulation of fibers may be supplied to correspond to the type of sheet to be manufactured. The resin supply unit 50 may be omitted from the configuration of the sheet manufacturing apparatus 100.

The resin supplied from the resin supply unit 50 is mixed with the passed material that passed through the openings of the screening unit 40 by a transfer blower 89 provided in the sixth transfer unit 86. The transfer blower 89 generates airflow to transfer the passed material and the resin to the refining unit 60 while mixing together.

The refining unit 60 refines the entangled passed material. Furthermore, the refining unit 60 refines the entangled resin when resin supplied from the resin supply unit 50 is fibrous. In addition, the refining unit 60 uniformly deposits the passed material and the resin in the deposition unit 72 to be described later. The term "refine" includes the action that separates entangled objects and the action that uniformly deposits. If there are no entangled objects, the action of uniform deposition results. A sieve is used as the refining unit 60. The refining unit 60 is a rotary sieve that rotates a mesh unit by a motor (not shown). Here, the "sieve" used as the refining unit 60 may not have the function of sorting specific target objects. That is, the "sieve" that is used as the refining unit 60 means an object provided with a mesh unit having a plurality of openings. The refining unit 60 may discharge all of the fiber materials and resin introduced to the refining unit 60 to the outside from the openings. In this case, the size of the openings of the refining unit 60 is at least the size of the openings of the screening unit 40. The configuration difference between the refining unit 60 and the screening unit 40 is that the refining unit 60 has a discharge port (corresponding to discharge port 47 of the screening unit 40). The refining unit 60 may be omitted from the configuration of the sheet manufacturing apparatus 100.

In the state in which the refining unit 60 is rotating, a mixture of the passed material (fibers) that passed through the screening unit 40 and the resin is introduced from the introduction port 66 into the interior of the refining unit 60 composed of the cylindrical mesh unit. The mixture introduced into the refining unit 60 moves to the mesh unit side by centrifugal force. As described above, the mixture introduced to the refining unit 60 sometimes includes entangled fibers and resin. The entangled fibers and resin are refined in the air by the rotating mesh unit. Then the refined fibers and resin are passed through the openings. The fibers and resin that passed through the openings pass through the air and are uniformly deposited in the deposition unit 72 to be described later.

The fiber materials and resin that passed through the openings of the refining unit 60 are deposited in the deposition unit 72 of the forming unit 70. The forming unit 70 has a deposition unit 72, a stretching roller 74, a heater roller 76, a tension roller 77, and a wind-up roller 78. The forming unit 70 uses the defibrated material and resin that passed through the refining unit 60 to form a sheet.

The deposition unit 72 in the forming unit 70 receives and deposits the fiber materials and resin that passed through the openings of the refining unit 60 to form the deposited material. The deposition unit 72 is positioned below the refining unit 60. The deposition unit 72 is, for example, a mesh belt. A mesh that is stretched by the stretching roller 74 is formed on the mesh belt. The deposition unit 72 is moved by the rotation of the stretching roller 74. While the deposition unit 72 continuously moves, the defibrated material and resin from the refining unit 60 continuously drop down to form a web having uniform thickness on the deposition unit 72.

A suction apparatus 79 (suction unit) for suctioning the deposited material from below is provided below the deposition unit 72. The suction apparatus 79 is positioned below the refining unit 60 with the deposition unit 72 therebetween and generates airflow directed downward (flow directed from the refining unit 60 to the deposition unit 72). Thus, the defibrated material and resin dispersed in the air can be suctioned, and the discharge speed from the refining unit 60 can be increased. The result is that the productivity of the sheet manufacturing apparatus 100 can be improved. In addition, a downflow can be formed in the drop path of the defibrated material and the resin by the suction apparatus 79, and the defibrated material and the resin can be prevented from becoming entangled during the drop. A fine particle collection container 92 is connected to the suction apparatus 79. Fine particles (paper dust or fine resin particles) having sizes that pass through the mesh of the deposition unit 72 are introduced into the fine particle collection container 92 by the airflow generated by the suction apparatus 79. Of the waste materials that could not be removed by the classifying unit 30, fine particles having minute sizes are collected here.

The defibrated material and resin deposited on the deposition unit 72 of the forming unit 70 are heated and pressurized by moving the deposition unit 72 and passing through the heater roller 76. By heating, the resin functions as a bonding agent to bond fibers together, and by applying pressure, the material is thinned. Furthermore, the surface is smoothed by passing through calendar rollers, which are not shown, to form a sheet P. In the example shown, the sheet P is wound onto a wind-up roller 78. From the above, a sheet P can be manufactured.

Figure 2:
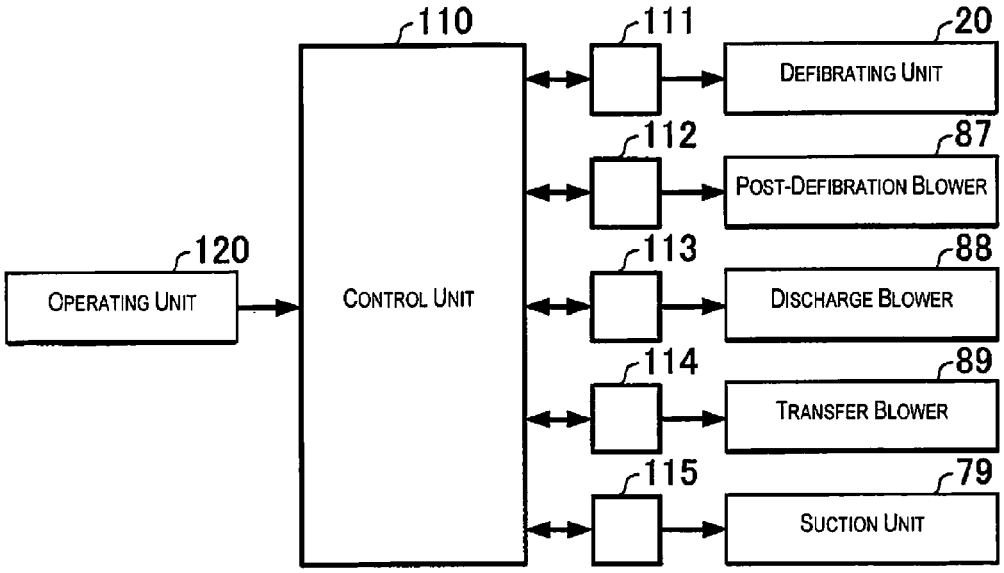
FIG. 2 is a functional block diagram of a sheet manufacturing apparatus related to this embodiment.

FIG. 2 shows a functional block diagram of the sheet manufacturing apparatus 100. The sheet manufacturing apparatus 100 includes a control unit 110 that includes a central processing unit (CPU) and a memory unit (ROM, RAM) and an operating unit 120 for the input of operating information.

A control unit 110 outputs control signals to a first to fifth drivers (motor drivers) 111 to 115. The first driver 111 controls the motor of the defibrating unit 20 based on control signals to drive the defibrating unit 20. The second driver 112 controls the motor of the post-defibration blower 87 based on control signals to drive the post-defibration blower 87. The third driver 113 controls the motor of the discharge blower 88 based on control signals to drive the discharge blower 88. The fourth driver 114 controls the motor of the transfer blower 89 based on control signals to drive the transfer blower 89. The fifth driver 115 controls the motor of the suction apparatus 79 based on control signals to drive the suction apparatus 79.

When operating information that instructs starting (start manufacturing) of the apparatus is received from the operating unit 120, the control unit 110 outputs control signals to the first to the fifth drivers 111 to 115 to start the drives of the various motors. When operating information that instructs stopping the apparatus is received from the operating unit 120, control signals are output to the first to the fifth drivers 111 to 115 to stop the drives of the various motors.

2. Method of the Embodiment

The methods of the start and stop controls in the sheet manufacturing apparatus 100 of this embodiment are described next.

In the sheet manufacturing apparatus 100 of this embodiment, materials are transferred in each process by airflow. In the sheet manufacturing apparatus 100, the configuration for generating airflow is the defibrating unit 20, the post-defibration blower 87, the discharge blower 88, the transfer blower 89, and the suction apparatus 79 (suction unit). The defibrating unit 20 and the post-defibration blower 87 generate airflow directed from the defibrating unit 20 to the classifying unit 30. The discharge blower 88 generates airflow directed from the upper discharge port 35 of the classifying unit 30 to the waste material collection container 90. The transfer blower 89 generates airflow directed from the screening unit 40 to the refining unit 60 (airflow directed from the classifying unit 30 to the deposition unit 72 when the sheet manufacturing apparatus 100 is not provided with the screening unit 40 and the refining unit 60). The suction apparatus 79 generates airflow directed from the refining unit 60 to the fine particle collection container 92.

Here, depending on the order in which each structure for generating airflow is started when the apparatus starts, or the order in which each structure for generating airflow is stopped when the apparatus stops, the generation of airflow directed from the waste material collection container 90 to the classifying unit 30, and the back flow of waste materials from the waste material collection container 90; or the generation of airflow directed from the fine particle collection container 92 to the refining unit 60, and the back flow of fine particles from the fine particle collection container 92 occur. The back flows of waste materials and fine particles becomes causes of the creation of sheets with the removed waste materials and fine particles mixed in, and the reduction in sheet quality. In the sheet manufacturing apparatus 100 of this embodiment, each structure for generating airflow when the apparatus starts is started in the appropriate order, or each structure for generating airflow when the apparatus stops is stopped in the appropriate order to suppress the back flow of waste materials and fine particles.

2-1. First Example

Figure 3:
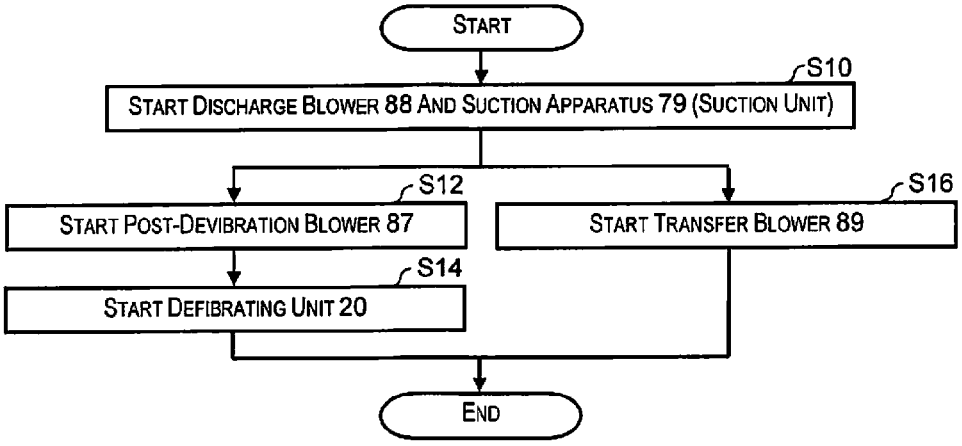
FIG. 3 is a flow chart showing the flow of start control in the first example.

FIG. 3 is a flow chart showing the flow of start control in the first example.

When the apparatus starts in the first example (when manufacturing starts), first, the control unit 110 outputs control signals to the third driver 113 and the fifth driver 115 to start the discharge blower 88 and the suction apparatus 79 (suction unit) (Step S10).

By starting the discharge blower 88 first, airflow toward the waste material collection container 90 can be generated, and back flow of waste materials from the waste material collection container 90 can be prevented. In addition, by starting the suction apparatus 79 first, airflow toward the fine particle collection container 92 can be generated, and back flow of fine particles from the fine particle collection container 92 can be prevented.

In addition, because the discharge blower 88 and the suction apparatus 79 generate mutually opposite airflows, when the suction apparatus 79 is started after the discharge blower 88 has stopped, airflow may be generated from the waste material collection container 90 to the classifying unit 30 (airflow causing the back flow of waste materials). When the discharge blower 88 is started after the suction apparatus 79 has stopped, airflow may be generated from the fine particle collection container 92 to the refining unit 60 (airflow causing the back flow of fine particles). Therefore, to prevent these situations, the discharge blower 88 and the suction apparatus 79 are controlled to start simultaneously.

The discharge blower 88 and the suction apparatus 79 do not have to start exactly simultaneously. When one of the discharge blower 88 and the suction apparatus 79 is started, the other may be started before the effects of the airflow of the former reach the other. Here, "effects . . . reach the other" refers to the generation of airflows as the back flows of waste materials and fine particles. The discharge blower 88 and the suction apparatus 79 are positioned with some degree of separation. Because the airflow does not reach the maximum immediately after starting, some offset is allowed between the start timing of the two.

After the discharge blower 88 starts, the control unit 110 outputs control signals to the second driver 112 to start the post-defibration blower 87 (Step S12). Here, after the discharge blower 88 runs stably, the control unit 110 starts the post-defibration blower 87. Here, "runs stably" refers to the motor being in the steady state. For example, when the third driver 113 is configured to output predetermined signals to the control unit 110 when the rotational speed of the motor of the discharge blower 88 is detected, and the rotational speed has reached a predetermined value (rotational speed in the steady state), the control unit 110 determines that the discharge blower 88 is running stably when the predetermined signal was received from the third driver 113, and starts the post-defibration blower 87.

By starting the post-defibration blower 87 before the defibrating unit 20, the load when starting the defibrating unit 20 can be reduced when materials remain inside the defibrating unit 20. In other words, when materials remain inside the defibrating unit 20, a load results when the defibrating unit 20 starts. If the load during starting is large, the starting torque is inadequate, and starting may not be possible.

After the post-defibration blower 87 runs stably, the control unit 110 outputs control signals to the first driver 111 to start the defibrating unit 20 (Step S14). After the post-defibration blower 87 runs stably, in order to remove the materials in the defibrating unit 20, the defibrating unit 20 may be started after a wait of several seconds.

After the suction apparatus 79 runs stably, the control unit 110 outputs control signals to the fourth driver 114 to start the transfer blower 89 (Step S16). After both the discharge blower 88 and the suction apparatus 79 run stably, the transfer blower 89 may be started. The discharge blower 88 can be started before the transfer blower 89 because the transfer blower 89 generates airflow in the reverse direction of the airflow generated by the discharge blower 88, and the back flow of waste materials from the waste material collection container 90 can be prevented.

Figure 4:
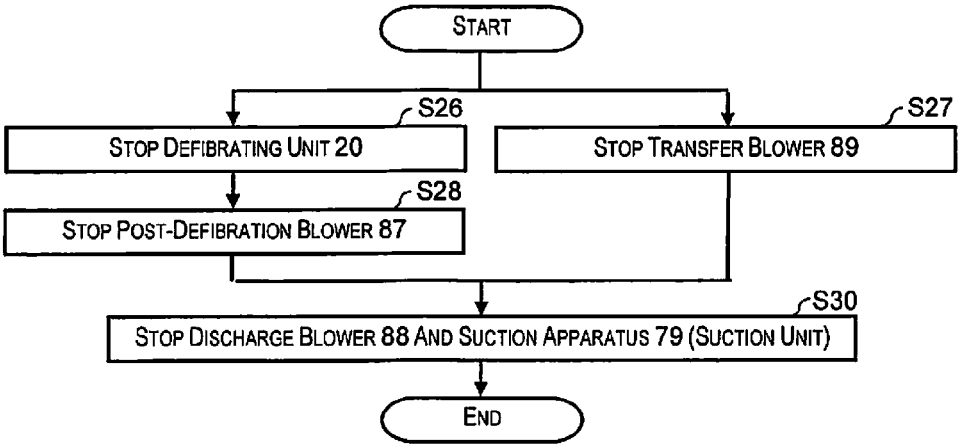
FIG. 4 is a flow chart showing the flow of stop control in the first example.

FIG. 4 is a flow chart showing the flow of stop control in the first example.

When the apparatus is stopped in the first example (when manufacturing stops), first, the control unit 110 outputs control signals to the first driver 111 and the fourth driver 114 to stop the defibrating unit 20 and the transfer blower 89 (Steps S26, S27).

After the defibrating unit 20 stops, the control unit 110 outputs control signals to the second driver 112 to stop the post-defibration blower 87 (Step S28).

After the post-defibration blower 87 stops, the control unit 110 outputs control signals to the third driver 113 to stop the discharge blower 88, and after the transfer blower 89 stops, outputs control signals to the fifth driver 115 to stop the suction apparatus 79 (Step S30). By stopping the discharge blower 88 last, airflow directed from the waste material collection container 90 to the classifying unit 30 is not generated, and the back flow of waste materials from the waste material collection container 90 can be prevented. In addition, by stopping the suction apparatus 79 last, airflow directed from the fine particle collection container 92 to the refining unit 60 is not generated, and the back flow of fine particles from the fine particle collection container 92 can be prevented, and residual fine particles can be collected until the end. Stopping the discharge blower 88 and the suction apparatus 79 simultaneously is preferred, but when one of the discharge blower 88 and the suction apparatus 79 is stopped, the other may be stopped before the effects of the airflow of the former reach the other.

2-2. Second Example

Figure 5:
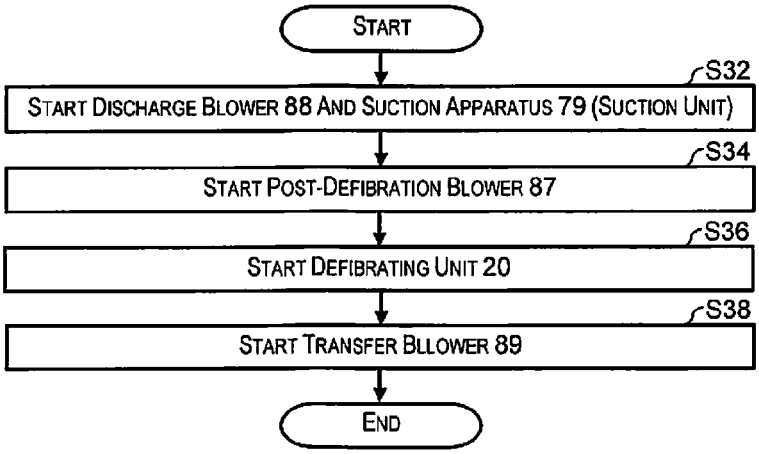
FIG. 5 is a flow chart showing the flow of start control in the second example.

FIG. 5 is a flow chart showing the flow of start control in the second example.

When there are no units open to the atmosphere in the pipes and apparatus between the discharge blower 88 and the suction apparatus 79, and there is a large difference between the amount of airflow generated by the discharge blower 88 and the amount of airflow generated by the transfer blower 89 and the suction apparatus 79, there may be interference between the airflows. For example, when the transfer blower 89 is started after the discharge blower 88 and the suction apparatus 79 start, the amount of airflow generated by the transfer blower 89 and the suction apparatus 79 is substantially greater than the amount of airflow generated by the discharge blower 88, airflow directed from the waste material collection container 90 to the classifying unit 30 may be generated. To avoid this kind of situation in the second example, the post-defibration blower 87 and the defibrating unit 20 are started before the transfer blower 89. Because the hopper 15 is connected to the upstream sides of the post-defibration blower 87 and the defibrating unit 20 and is open to the atmosphere, even if the post-defibration blower 87 and the defibrating unit 20 start, airflow directed from the waste material collection container 90 to the classifying unit 30 is not generated.

In other words, when the apparatus is started in the second example, first, the control unit 110 starts the discharge blower 88 and the suction apparatus 79 (Step S32); starts the post-defibration blower 87 after the discharge blower 88 and the suction apparatus 79 run stably (Step S34); starts the defibrating unit 20 after the post-defibration blower 87 runs stably (Step S36); and starts the transfer blower 89 after the defibrating unit 20 runs stably (Step S38).

Figure 6:
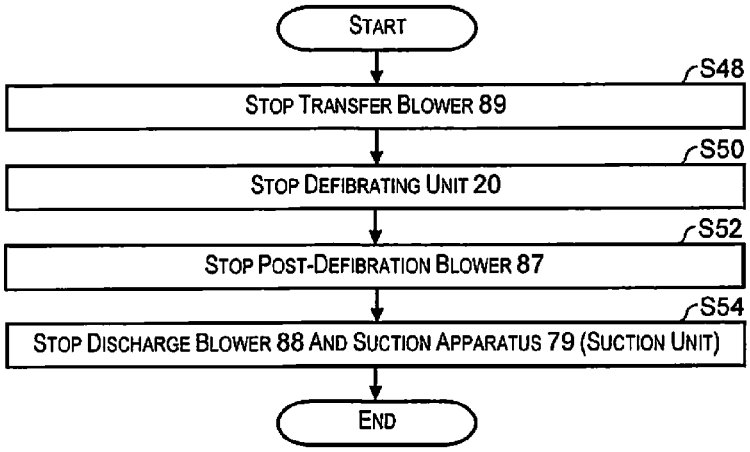
FIG. 6 is a flow chart showing the flow of stop control in the second example.

FIG. 6 is a flow chart showing the flow of stop control in the second example.

When the apparatus is stopped in the second example, in reverse to when starting the apparatus, the transfer blower 89 is stopped before the post-defibration blower 87 and the defibrating unit 20. First, the control unit 110 stops the transfer blower 89 (Step S48); stops the defibrating unit 20 after the transfer blower 89 stops (Step S50); and stops the post-defibration blower 87 after the defibrating unit 20 stops (Step S52). The explanation of Step S54 in FIG. 6 is omitted because it is similar to that in Step S30 in FIG. 4.

2-3. Third Example

Figure 7:
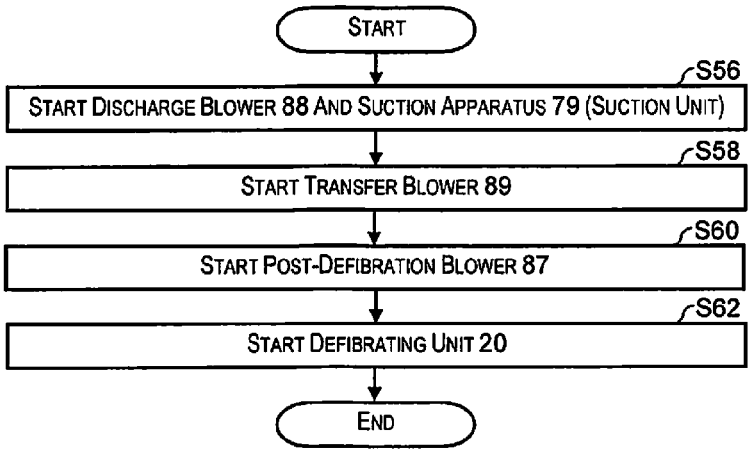
FIG. 7 is a flow chart showing the flow of start control in the third example.

FIG. 7 is a flow chart showing the flow of start control in the third example.

When the case in which fine particles remain in the pipe pathways before starting the apparatus is considered, control is considered in which starting is in order from the fine particle collection container 92 to the nearest unit. By collecting fine particles from the fine particle collection container 92 to the nearest unit, the pipes do not clog, and the fine particles remaining in the pipes can be removed. For example, when the post-defibration blower 87 and the defibrating unit 20 are started when the transfer blower 89 is stopped, fine particles and the like accumulate upstream of the transfer blower 89 and may clog the pipes. Therefore, in the third example, the transfer blower 89 is started before the post-defibration blower 87 and the defibrating unit 20 in order to prevent this type of situation.

In other words, when the apparatus is started in the third example, first, the control unit 110 starts the discharge blower 88 and the suction apparatus 79 (Step S56); starts the transfer blower 89 after the discharge blower 88 and the suction apparatus 79 run stably (Step S58); starts the post-defibration blower 87 after the transfer blower 89 runs stably (Step S60); and starts the defibrating unit 20 after the post-defibration blower 87 runs stably (Step S62).

Figure 8:
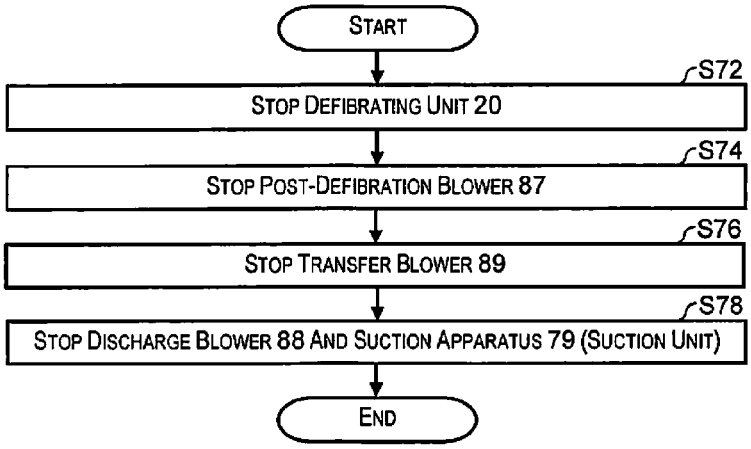
FIG. 8 is a flow chart showing the flow of stop control in the third example.

FIG. 8 is a flow chart showing the flow of stop control in the third example.

When the apparatus is stopped in the third example, in reverse to when the apparatus is started, the post-defibration blower 87 and the defibrating unit 20 are stopped before the transfer blower 89. First, the control unit 110 stops the defibrating unit 20 (Step S72); stops the post-defibration blower 87 after the defibrating unit 20 stops (Step S74); and stops the transfer blower 89 after the post-defibration blower 87 stops (Step S76). The explanation of Step S78 in FIG. 8 is omitted because it is similar to that for Step S30 in FIG. 4.

3. Modified Examples

The present invention includes essentially the same configurations that were explained in the examples (configurations having the same functions, methods, and results; or configurations having the same objectives and effects). In addition, the present invention includes configurations in which parts that are not essential in the configurations explained in the examples are replaced. And the present invention includes configurations that carry out the actions and effects identical to those in the configurations explained in the examples, or configurations that are able to achieve the same objectives. In addition, the present invention includes configurations in which known technologies were added to the configurations described in the examples.

A sheet manufactured by the sheet manufacturing apparatus 100 primarily indicates a sheet-like object. However, the shape is not limited to a sheet, a board form or a web form is possible. The sheet in this Specification is divided into paper and nonwoven cloth. Paper includes molding pulp or used paper as the raw materials formed into thin sheets, and includes recording paper, wallpaper, wrapping paper, colored paper, drawing paper, and Kent paper that have the objective of writing or printing. Nonwoven cloth is thicker and has less strength than paper, and includes ordinary nonwoven cloth, fiberboard, tissue paper, paper towels, cleaning cloths, filters, liquid-absorbing materials, sound-absorbing materials, cushioning materials, and mats. The raw materials may be plant fibers such as cellulose, and the like; synthetic fibers such as polyethylene terephthalate (PET), polyester, and the like; and animal fibers such as wool, silk, and the like.

After airflow control by each start control of FIG. 3, FIG. 5, and FIG. 7, the screening unit 40, the refining unit 60, and the crushing unit 10 may be started. In addition, before each stop control in FIG. 4, FIG. 6, and FIG. 8, the screening unit 40, the refining unit 60, and the crushing unit 10 (supply unit) may be stopped.

A water sprayer for spraying to add water to the deposited material that was deposited in the deposition unit 72 may be provided. Thus, the strength of hydrogen bonds when the sheet P is formed can be increased. The spraying and addition of water is carried out on the deposited material before the material is passed through the heater roller 76. Starch or polyvinyl alcohol (PVA) and the like may be added to the water sprayed by the water sprayer. Thus, the strength of the sheet P can be further improved.

In the examples described above, the embodiment in which the sheet P is wound onto the wind-up roller 78 was explained. However, the sheet P may be cut to the desired size by a cutting machine, which is not shown, and stacked by a stacker.

The crushing unit 10 does not have to be in the sheet manufacturing apparatus 100. For example, if objects crushed by a shredder and the like are the raw materials, the crushing unit 10 is not needed.

The fifth transfer unit 85 may be eliminated as the return flow path. The residue may be collected and eliminated without returning to the defibrating unit 20. In addition, if there is the defibrating unit 20 having performance so that residue does not come out, the fifth transfer unit 85 becomes unnecessary.

In this application, "fiber materials" in "fiber materials are deposited to form deposited material" and "fiber materials are used to form a sheet" may include all of the fiber materials classified in the classifying unit 30, a portion of the fiber materials classified in the classifying unit 30 (passed material that is passed through the screening unit 40), and fiber materials with added resin and the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sheet manufacturing apparatus, comprising:

a defibrating unit configured to dry-defibrate material containing fibers;

a classifying unit disposed downstream relative to the defibrating unit in a direction in which defibrated material, which has been dry-defibrated at the defibrating unit, is transferred, the classifying unit being configured to classify by airflow the defibrated material into fiber material and waste material;

a screening unit disposed downstream relative to the classifying unit in a transfer direction in which the fiber material is transferred, and configured to screen the fiber material;

a transfer path disposed downstream relative to the screening unit in the transfer direction, the transfer path including a supply port that is disposed on the transfer path and is configured to supply resin to an inside of the transfer path;

a refining unit disposed downstream relative to the transfer path in the transfer direction, the refining unit being configured to refine the fiber material and the resin;

a transfer blower attached to the transfer path, the transfer blower being disposed downstream relative to the supply port and upstream relative to the refining unit in the transfer direction, the transfer blower including a motor to drive the transfer blower and being configured to transfer the fiber material and the resin by airflow through the transfer path;

a deposition unit disposed downstream relative to the refining unit in the transfer direction, the deposition unit being configured to deposit the fiber material and the resin, which has been transferred by the transfer blower, to create deposited material;

a discharge blower configured to discharge the waste material, which has been classified at the classifying unit, by airflow from the classifying unit such that the waste material does not move toward a side of the deposition unit;

a suction unit configured to suction the deposited material deposited at the deposition unit from below;

a forming unit disposed downstream relative to the deposition unit and the suction unit, the forming unit being configured to form a sheet by using the deposited material which has been suctioned at the suction unit; and a controller configured to control driving of the defibrating unit, the classifying unit, the motor of the transfer blower, the deposition unit, the discharge blower, the suction unit, and the forming unit, when manufacturing by the sheet manufacturing apparatus starts, the controller being configured to control the discharge blower to be driven before controlling the motor of the transfer blower to be driven.

2. The sheet manufacturing apparatus according to claim 1, wherein when the manufacturing by the sheet manufacturing apparatus starts, the controller is configured to control the suction unit to be driven before controlling the motor of the transfer blower to be driven.

3. The sheet manufacturing apparatus according to claim 1, wherein when the manufacturing by the sheet manufacturing apparatus starts, the controller is configured to control one of the discharge blower and the suction unit to be driven before an effect of airflow caused by driving of the other reaches the one.

4. The sheet manufacturing apparatus according to claim 1, wherein when the manufacturing by the sheet manufacturing apparatus starts, the controller is configured to control the discharge blower to be driven before controlling the defibrating unit to be driven.

5. A sheet manufacturing method, comprising:

dry-defibrating material containing fibers;

classifying by airflow defibrated material, which has been dry-defibrated, into fiber material and waste material by a classifying unit;

screening the fiber material by a screening unit;

transferring by airflow the fiber material through a transfer path by a transfer blower, the transfer path being disposed downstream relative to the screening unit in a transfer direction in which the fiber material is transferred, the transfer blower being attached to the transfer path, being disposed downstream relative to the screening unit in the transfer direction, and including a motor to drive the transfer blower;

supplying resin to an inside of the transfer path through a supply port that is disposed on the transfer path and upstream relative to the transfer blower in the transfer direction;

refining the fiber material and the resin by a refining unit which is disposed downstream relative to the transfer path and the transfer blower in the transfer direction;

depositing the fiber material being transferred to create deposited material by a deposition unit disposed downstream relative to the refining unit in the transfer direction;

discharging by a discharge blower the waste material by airflow from the classifying unit such that the waste material does not move toward a side of the deposition unit;

suctioning the deposited material from below;

forming a sheet by using the deposited material; and controlling the discharge blower to be driven before controlling the motor of the transfer blower to be driven, when manufacturing of the sheet starts.

6. The sheet manufacturing apparatus according to claim 1, wherein when the manufacturing by the sheet manufacturing apparatus starts, the controller is configured to control the suction unit and the discharge blower to be driven simultaneously.

7. The sheet manufacturing apparatus according to claim 1, further comprising a post defibration blower including a motor to drive the post defibration blower and configured to transfer the defibrated material, which has been defibrated at the defibrating unit, by airflow to the classifying unit.

8. The sheet manufacturing apparatus according to claim 7, wherein the controller is further configured to control driving of the post defibration blower, when the manufacturing by the sheet manufacturing apparatus starts, the controller is configured to control the post defibration blower to be driven after controlling the discharge blower and the suction unit to be driven.

9. The sheet manufacturing apparatus according to claim 8, wherein when the manufacturing by the sheet manufacturing apparatus starts, the controller is configured to control the post defibration blower to be driven before controlling the defibration unit to be driven.

* * * * *